US006942565B2

(12) United States Patent
Karn et al.

(10) Patent No.: US 6,942,565 B2
(45) Date of Patent: Sep. 13, 2005

(54) ELECTRONIC CARD GAME AND METHOD

(75) Inventors: Jeff Karn, Warrington, PA (US); Chris Walsh, Plymouth Meeting, PA (US)

(73) Assignee: Merit Industries, Inc., Bensalem, PA (US)

( * ) Notice: Subject to any disclaimer, the term of this patent is extended or adjusted under 35 U.S.C. 154(b) by 0 days.

(21) Appl. No.: 10/663,029

(22) Filed: Sep. 15, 2003

(65) Prior Publication Data

US 2004/0142736 A1 Jul. 22, 2004

(51) Int. Cl.[7] ..... A63A 1/00

(52) U.S. Cl. ..... 463/11; 463/16; 463/23; 273/292

(58) Field of Search ..... 463/9, 11–12, 463/16, 18; 273/292, 293, 440, 459, 460

(56) References Cited

U.S. PATENT DOCUMENTS

| | | | | |
|---|---|---|---|---|
| 5,711,715 | A * | 1/1998 | Ringo et al. | 473/9 |
| 5,882,258 | A * | 3/1999 | Kelly et al. | 463/11 |
| 6,368,214 | B1 * | 4/2002 | Luciano | 463/18 |
| 6,739,970 | B2 * | 5/2004 | Luciano | 463/18 |
| 2002/0052229 | A1 * | 5/2002 | Halliburton et al. | 463/9 |
| 2003/0199297 | A1 * | 10/2003 | Falciglia | 463/16 |

OTHER PUBLICATIONS

Solitaire Mahjongg website: <home.halden.net/vkp/vkp/freeware.html> different configurations of solitaire using Mahjongg tiles, 20 pgs.*

Solitaire Manic websit, <web.archive.org/web/20020528115245/http://www.smaniac.com/> release date Mar. 3, 2002 version 1.4 contains 202 different games (255 variations of solitaire), Example of Kaleidoscope Solitaire (3 screen shots) 6 total pgs.*

123 Free Solitaire—Version 5.0—Feb. 1, 2001□□Copyright 1998–2001. 5 Screen shots.□□123freesolitaire.com.*

Solitaire Mahjongg website, different configurations of solitaire using Mahjongg tiles, 20 pgs.*

Solitaire Maniac website, release Date Mar. 3, 2002 version 1.4 contains 202 different games (255 variations of solitaire). Example of Kaleidoscope Solitaire.*

* cited by examiner

*Primary Examiner*—Jessica Harrison
*Assistant Examiner*—Alex F. R. P. Rada, II
(74) *Attorney, Agent, or Firm*—Akin Gump Strauss Hauer & Feld, LLP

(57) ABSTRACT

An electronic card game playable in an amusement device having a display includes an electronic deck of cards having a plurality of cards that each have an associated face value. A first layer of cards is disposed on a playing area and a second layer of cards is disposed in overlying relationship thereto. The rules include scoring points based upon a run of play which is a duration of time when the player can selectively remove cards that are one face value higher or lower than the face value of the last card in the shoe, permitting a card in the first layer to become playable when all the cards of the second layer which were partially covering the card in the first layer have been removed, and allowing three or more cards in the first layer to become playable when one card of the second layer is removed.

29 Claims, 9 Drawing Sheets

ELECTRONIC CARD GAME AND METHOD

BACKGROUND OF THE INVENTION

The present invention relates generally to an electronic card game and method of playing an electronic card game, and more particularly, to an electronic card game and method therefore where cards are arranged in overlying relationship and the selection of a single card allows a plurality of cards to become playable.

Electronic card games such as Solitaire games for computers and touchscreen or other types of amusement devices are generally well known in the art. New variations of games which are more fast paced and require the player to strategize about a selected card are currently sought after. One prior art game, such as Tri Towers™, commercially available from Merit Industries, Inc., Bensalem, Pa. includes cards which are laid out on a screen in three "towers" of four overlapping levels. The remaining deck of cards are placed at the bottom of the screen or playing area with the first card turned face up. The object of the Tri Towers™ game is to capture each of the three towers by removing the cards beneath it. To remove the cards, one of the cards is selected in the playing field that is one higher or one lower (i.e., one face value higher or one face value lower) than the face value of the deck card or shoe card. If no move is possible, the player selects to turn over the next card in the deck. The player continues to turn over deck cards until all the cards have been removed from the play field or until the deck is exhausted. Bonus points are scored for capturing a tower or for not having to turn over deck cards.

It is desirable to provide an electronic card games which permits three cards to become playable simultaneously by removing a single card from the playing field. Further, it is desirable to provide an electronic card game wherein more than three cards become playable when a single card is removed from the playing field.

BRIEF SUMMARY OF THE INVENTION

Briefly stated, the present invention comprises an electronic card game playable in an amusement device having a display. The electronic card game includes an electronic deck of cards having a plurality of individual playing cards. Each of the individual playing cards has an associated face value. The game further includes a playing area within the display. A first layer of cards of the deck is disposed on the playing area and a second layer of cards of the deck is disposed on the playing area in overlying relationship to the first layer of cards. At least one card of the second layer of cards is partially covering at least three cards of the first layer of cards. The game also includes a shoe of cards configured to accept cards of the deck that have been selectively removed from the playing area by a player. The shoe is disposed proximate to or within the playing area. The game includes a set of rules dictating scoring of the electronic card game. The rules include selecting cards from the playing area that are not covered by other cards and that have a face value that is one face value higher or one face value lower than the face value of the last card showing in the shoe. Further, the rules include scoring points based upon a run of play where run of play is a duration of time when the player can selectively remove cards that are one face value higher or one face value lower than the face value of the last card in the shoe. The rules also include permitting a card in the first layer to become playable when all the cards of the second layer which were partially covering the card in the first layer have been removed, and allowing, in at least some instances, three or more cards in the first layer to become playable when one card of the second layer is removed.

The present invention further comprises a method of playing an electronic card game as set forth above in an amusement device having a display in accordance with the set of rules.

In yet another aspect, the present invention is an electronic game playable in an amusement device having a display where the game includes an electronic deck of game pieces having a plurality of individual game pieces. Each of the individual game pieces has an associated face value and at least three of the game pieces have different face values. The game includes a playing area within the display. A first layer of game pieces of the deck are disposed on the playing area and the second layer of game pieces of the deck are disposed in the playing area in overlying relationship to the first layer of game pieces. At least one game piece of the second layer of game pieces partially covers at least three game pieces of the first layer of game pieces. The game also includes a shoe of game pieces configured to accept game pieces of the deck that have been selectively removed from the playing area by a player. The shoe is disposed proximate to or within the playing area. The game includes a set of rules which dictate scoring of the electronic game. The rules include selecting game pieces from the playing area that are not covered by other game pieces and that have a face value that is one face value higher or one face value lower than the face value of the last game piece showing in the shoe. The rules also include scoring points based upon a run of play where run of play is a duration of time when the player can selectively remove game pieces that are one face value higher or one face value lower than the face value of the last game piece in the shoe. Further, the rules include permitting the game piece in the first layer to become playable when all the game pieces of the second layer which were partially covering the game piece in the first layer have been removed, and allowing, in at least some instances, three or more game pieces in the first layer to become playable when one game piece of the second layer is removed.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
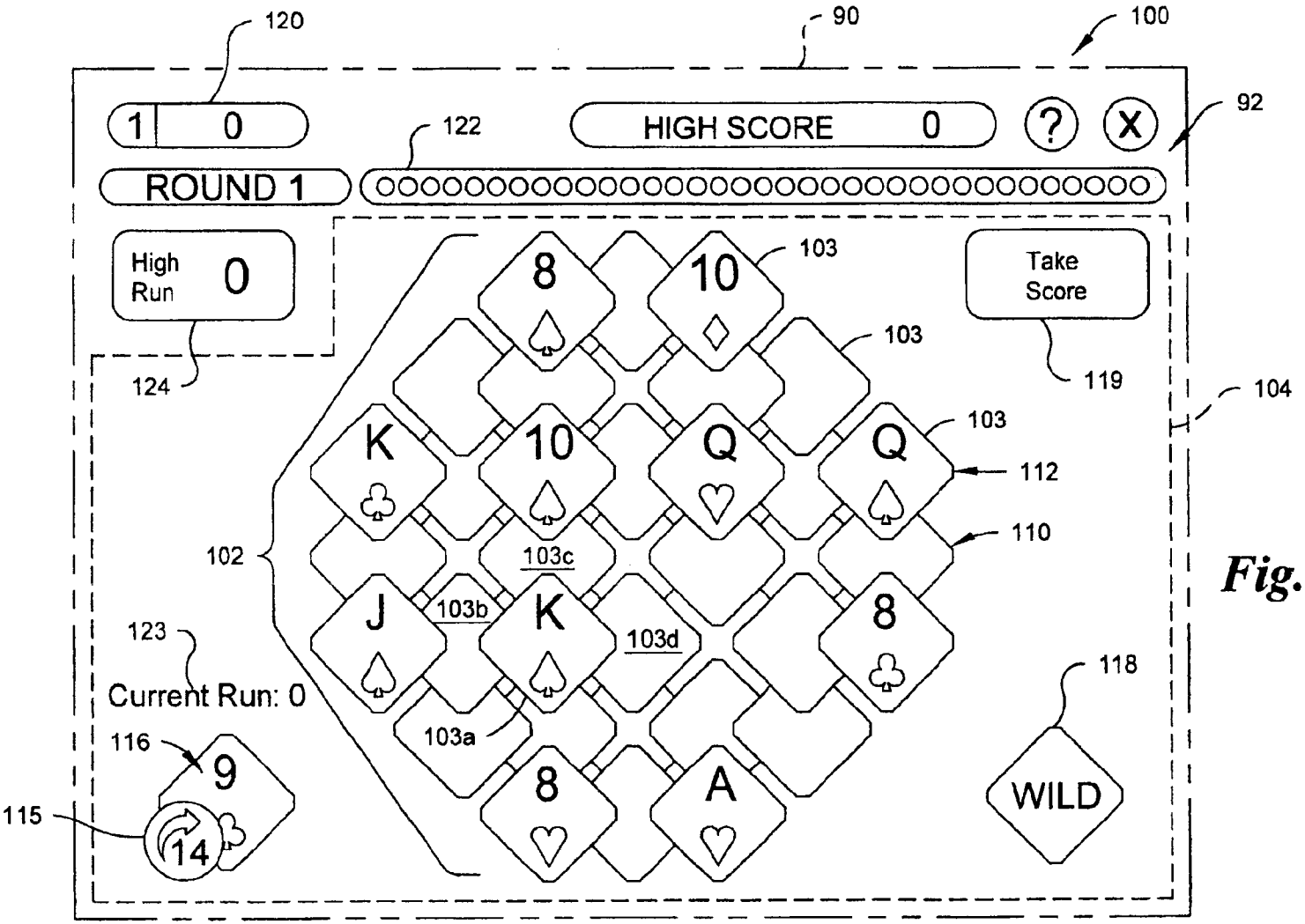
FIG. 1 is a screen shot of electronic card game in accordance with a first preferred embodiment.

Certain terminology is used in the following description for convenience only and should not be construed as limiting. The word "a" as used in the claims and in the corresponding portions of the Specification, means "one or more than one." In the drawings, the same reference numerals are employed for designating the same elements throughout the figures.

Referring to the drawing in detail, FIGS. 1–4 depict an electronic card game 100 playable in an amusement device 90, such as a touchscreen amusement device, having a display 92 in accordance with a first preferred embodiment of the present invention. The electronic card game 100 includes an electronic deck of cards 102 having a plurality of individual playing cards 103. The deck of cards 102 may be a conventional deck of cards comprising fifty-two (52) cards 103. However, the deck of cards 102 may include any number of cards 103 without departing from the invention. Each of the individual playing cards 103 has an associated face value and/or denomination (i.e., 2–10 and Jack, Queen, King and Ace and/or Hearts, Clubs, Spades and Diamonds, respectively). The electronic card game 100 includes a playing area 104 within the display 92. The electronic card game 100 also includes a first layer of cards 110 of the deck 102 disposed on the playing area 104, and a second layer of cards 112 of the deck 102 disposed on the playing area 104 in overlying relationship to the first layer of cards 110. At least one card 103*a* (e.g., the King of Spades) of the second layer 112 of cards 103 partially covers at least three cards 103*b*–103*d* of the first layer 110 of cards 103 The electronic card game 100 further includes a shoe 116 of cards 103 configured to accept cards 103 of the deck 102 that have been selectively removed from the playing area 104 by a player (not shown). The shoe 116 is disposed proximate to or within the playing area 104. The electronic card game 100 further includes a deck button 115 for dealing cards 103 that have not been dealt. As shown in FIG. 1, fourteen (14) cards 103 have not been dealt. The deck button 115 is disposed proximate to or within the playing area 104. As shown in FIGS. 1–4 the deck 102 comprises the cards 103 in the shoe 116, the cards 103 that have not been dealt, and the cards 103 spread out on the playing area 104 in overlying relationship.

The electronic card game 100 includes a set of rules which dictate scoring of the electronic card game 100. The rules include selecting cards 103 from the playing area 104 that are not covered by other cards 103 and that have a face value (i.e., 2–10, Jack-Ace) that is one face value higher or one face value lower than the face value of the last card 103 showing in the shoe 116. The rules further include scoring points based upon a run of play. A run of play is a duration of time when the player can selectively remove cards 103 that are one face value higher or one face value lower than the face value of the last card 103 in the shoe 116. The rules also include permitting a card 103 such as cards 103*b*–103*d* in the first layer 110 to become playable when all the cards 103 such as 103*a* which were partially covering the card 103*b*–103*d* in the first layer 10 have been removed. The rules include allowing, in at least some instances, three or more cards 103 in the first layer 110 to become playable when one card 103 of the second layer 112 is removed.

As shown in FIGS. 1–4, the cards 103 have conventional face values including Ace, 2, 3, 4, 5, 6, 7, 8, 9, 10, lack (J), Queen (Q), and King (K). The cards 103 also have denominations including Hearts, Diamonds, Clubs and Spades. However, the cards 103 may include any denominations or face values using other numbering systems without departing from the present invention.

The electronic card game 100 may also include a wild card 118 which is disposed proximate to or within the playing area 104 and separate from the layers of cards 110, 112, and the shoe 116. The wild card 118 may be selectable by the player when there are no playable cards 103 that are one face value higher or one face value lower than the face value of the last card 103 in the shoe 116. Alternatively, the wild card 118 may be selected by the player at any time, thereby permitting the player to select any playable card 103 for strategic purposes. Furthermore, the player may select the deck button 115 to deal one of the cards 103 that were not previously dealt to the shoe 116 in an attempt to prevent a run from ending by changing the face value of the card 103 face up on the shoe 116.

While described above as including a first layer and a second layer of cards 110, 112, the electronic game 100 preferably includes a plurality of layers 110, 112 set out in overlying relationship on the playing area 104. The electronic card game 100 may also include a plurality of decks of cards 102 which form additional layers 110, 112 in overlying relationship relative to the second layer 112 of cards 103.

The cards 103 shown in FIGS. 1–4 have a unique diamond-like shape with chamfered corners thereby permitting the cards 103 to be positioned in overlying relationship without touching adjacent cards 103 in the same layer 110 or 112. However, the cards 103 may have other shapes such as a square shape, a rectangular shape, a circular shape, a pentagonal shape, an octagonal shape or even non-linear or non-geometric shapes.

The electronic card game 100 further includes a "take score" selector 119 disposed proximate to or within the playing area 104 and separate from the layers of cards 110 or 112 and the shoe 116. The take score selector 119 allows a user to end a round of play when the cards 103 remaining in the playing area 104 are no longer playable and a wild card 118 is not available.

The electronic card game 100 also includes a total score indicator 120 which is disposed proximate to or within the playing area 104. A total score for a run of play is incremented or decremented based upon the number of playable cards 103 selected by the player in a run. The electronic game 100 also includes a time indicator 122, in this case configured as a bar graph, which displays the amount of time that a player has used during a round. A round may include multiple runs of play. A round is ended when a predetermined period of time as counted down on the time indicator 122 has elapsed, when the player selects the take score button 119 or when a player has played all of the cards 103 spread out on the playing area 104. Preferably, the total score which is indicated on the total score indicator 120 is also a function of the amount of time the player takes to select the next playable card 103.

Figure 2:
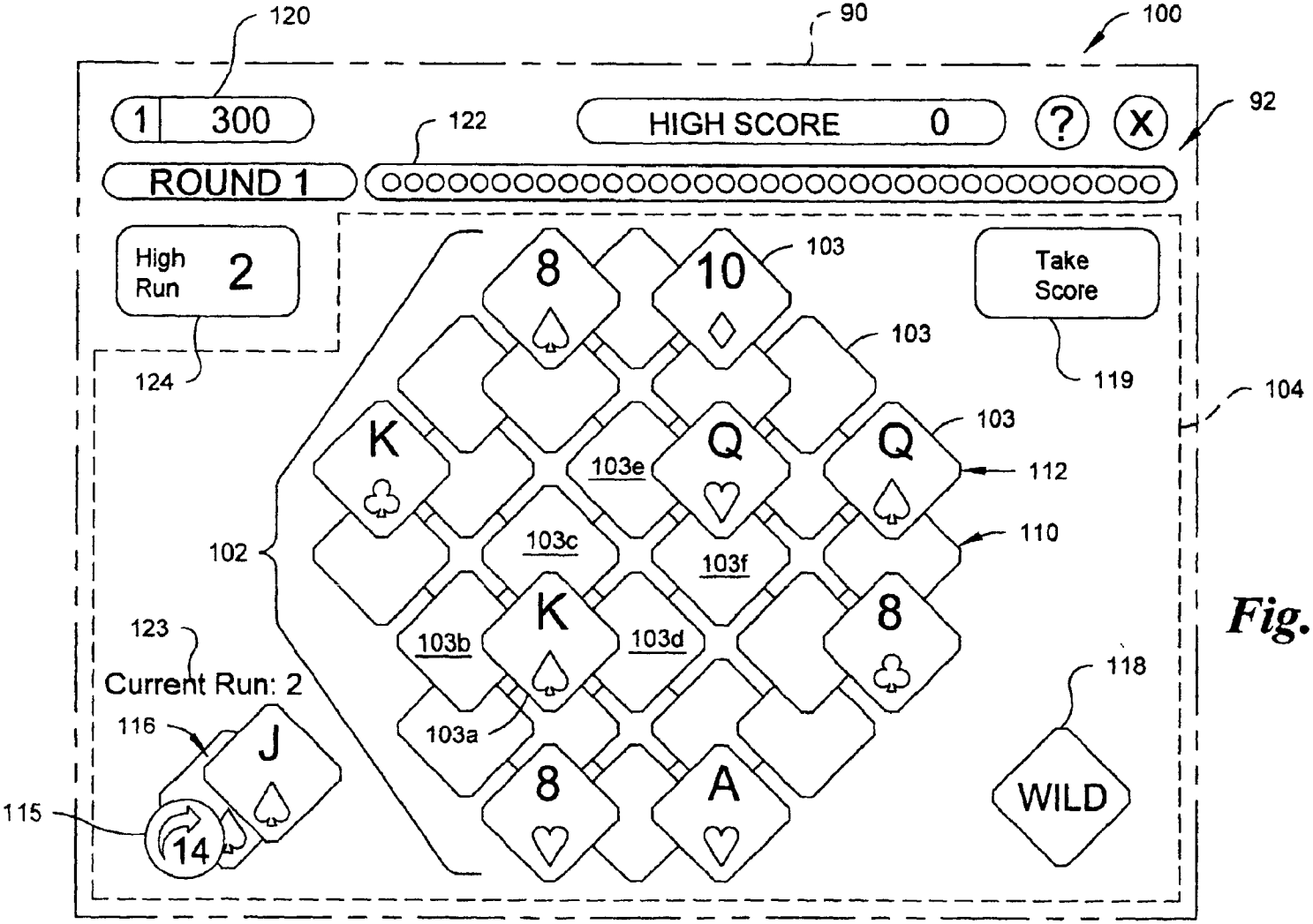
FIG. 2 is a screen shot of the electronic card game of FIG. 1 after a card has been selectively removed by a user.
Figure 3:
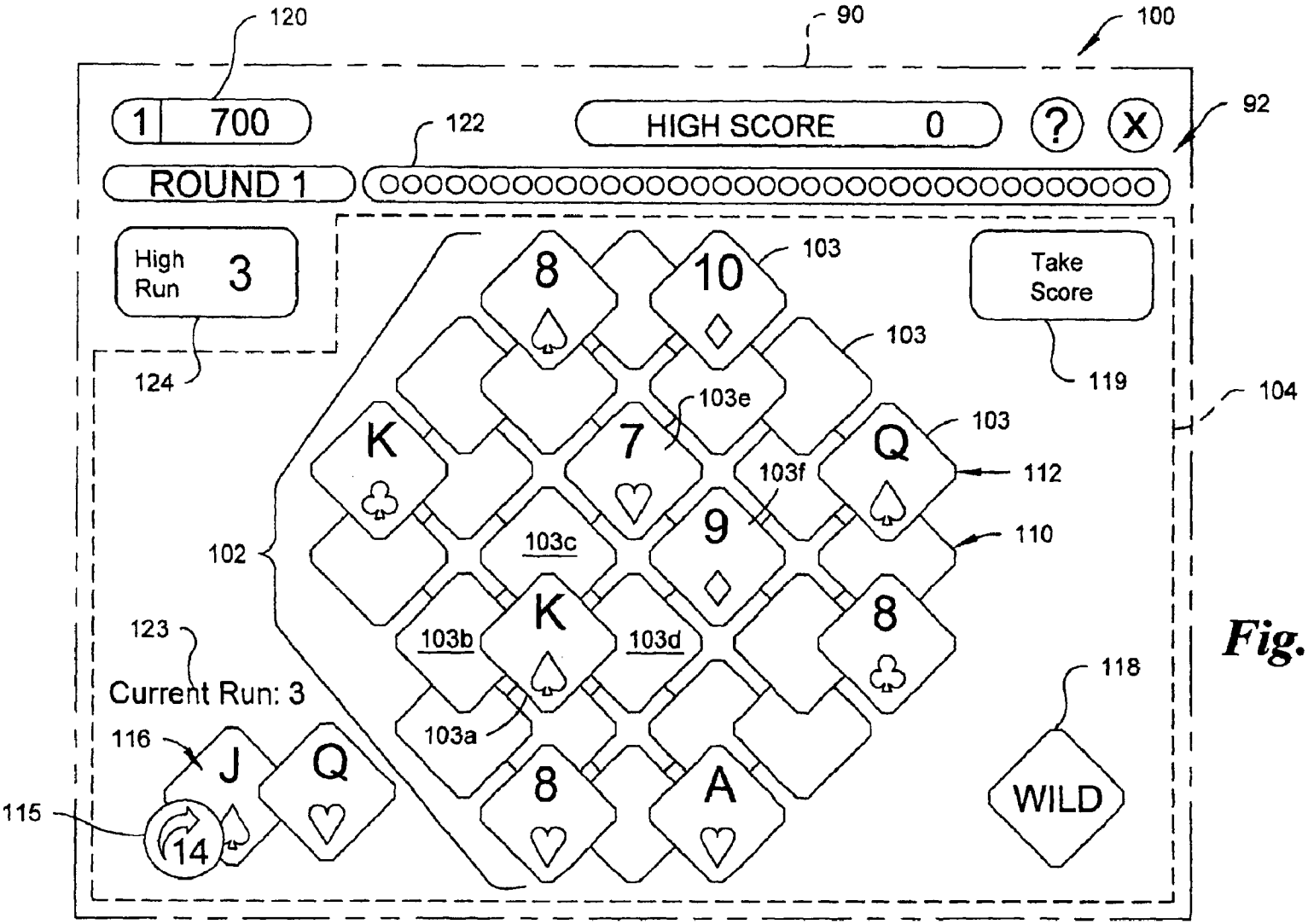
FIG. 3 is a screen shot of the electronic card game of FIG. 1 after another card has been selectively removed by a user.
Figure 4:
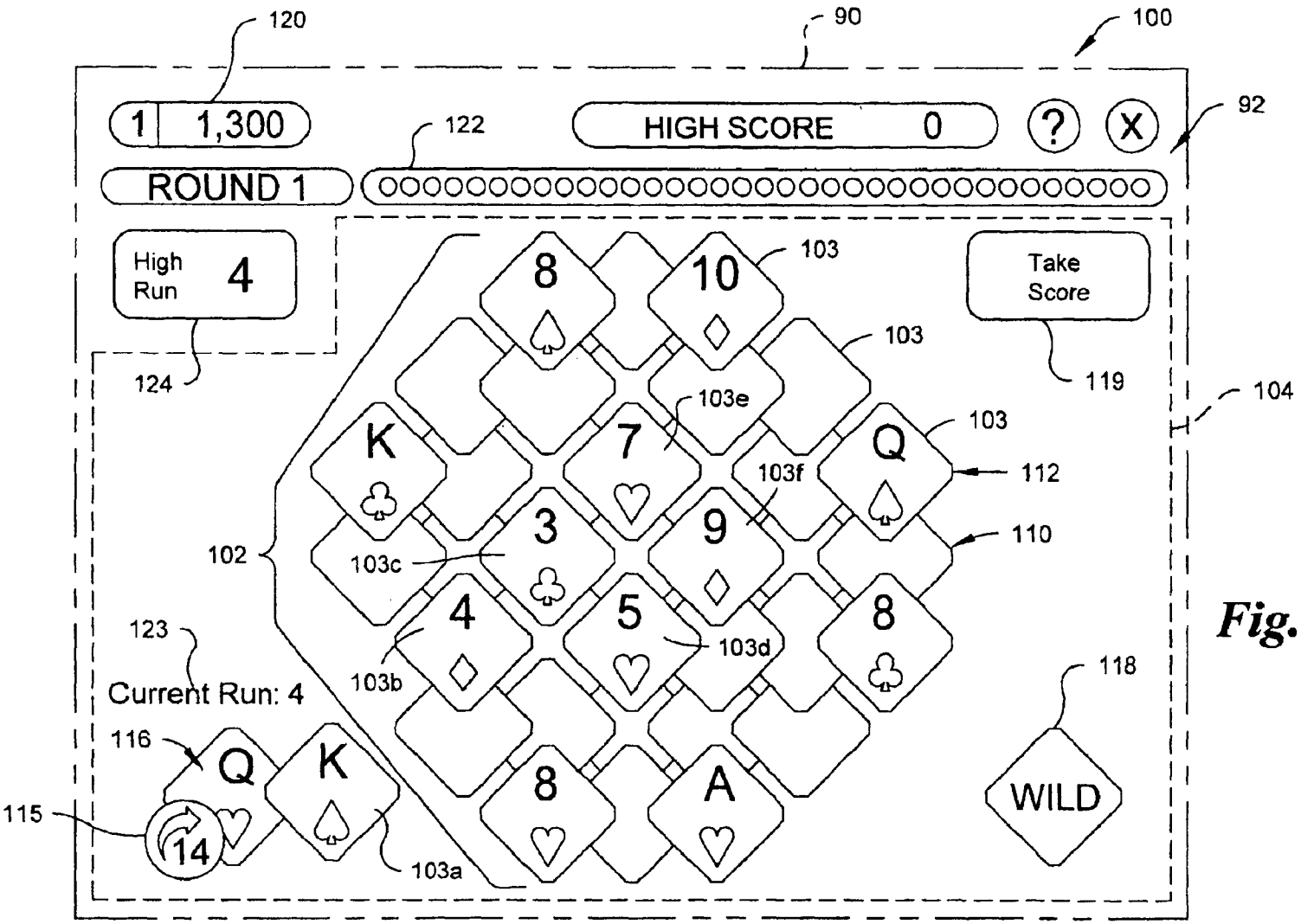
FIG. 4 is a screen shot of the electronic card game of FIG. 1 after yet another card has been selectively removed by a user.

By way of example, a run of play will be explained with respect to FIGS. 1–4. In FIG. 1, the 9 of Clubs is the top card 103 in the shoe 116 and the score on the indicator 120 is zero. The cards 103 in the second layer 112 are shown face up and include the King of Clubs, the Jack of Spades, the 8 of Spades, the 10 of Spades, the King of Spades, the 8 of Hearts, the 10 of Diamonds, the Queen of Hearts, the Ace of Hearts, the Queen of Spades, and 8 of Clubs. FIG. 2 shows that the player has selected the 10 of Spades which was moved to the shoe 116 being one face value higher than the 9 of Clubs. Also shown in FIG. 2, the user has selected the Jack of Spades which is in the process of being moved to the shoe 116 in overlying relationship to the 10 of Spades which was the previous face card being one face card value lower than the Jack of Spades on top of the shoe 116. The score indicator shows that the player has accumulated 300 points. Although any point value can be associated with the run of play, in this particular embodiment, the score is progressively increased based upon the number of cards 103 selected in a single run and also as a function of the time elapsed in the time indicator 122. A current run indicator 123 shows the number of cards 103 selected during a particular run and moved to the shoe 116. The higher the value on the current run indicator 123, the more points a player will accumulate as displayed in the score indicator 120. A high run indicator 124 may optionally display the highest run played on a particular amusement device 90. FIG. 3 shows that a third card, the Queen of Hearts has been selected by the user and is being moved to the shoe 116 to cover the Jack of Spades which is one face value lower than the Queen of Hearts. The current run indicator 123 shows that the run is 3 and the score has accumulated to 700 as shown in the score indicator 120 which is obviously a non-linear increase from the number of points accumulated in the first two selections. Also note that the Queen of Hearts (FIG. 2) was disposed over top cards 103*e*, 103*f* in the first layer 110. When the Queen of Hearts was removed from the second layer 112 by the user, no other cards 103 were then in overlying relationship with cards 103*e*, 103*f*, thereby allowing those cards to become playable (i.e., the 7 of Hearts and the 9 of Diamonds, respectively). FIG. 4 shows that the King of Spades has been removed from the second layer 112 of cards 103 and is being moved to the shoe 116 which is permissible because the King is one face value higher than the Queen. The current run indicator 123 shows that this is the fourth card 103 in the run and accordingly, the score indicated in the score indicator 120 has increased in non-linear relationship to the previous three runs and is now showing 1300. When the King of Spades was removed from the second layer 112, cards 103*b* and 103*c* in the first layer were no longer covered, and therefore, cards 103*b*–103*d*, the 4 of Diamonds, the 3 of Clubs, the 5 of Hearts, respectively, became playable. When the King of Spades was removed, all three cards 103*b*–103*d* become playable in accordance with the rules.

Figure 5:
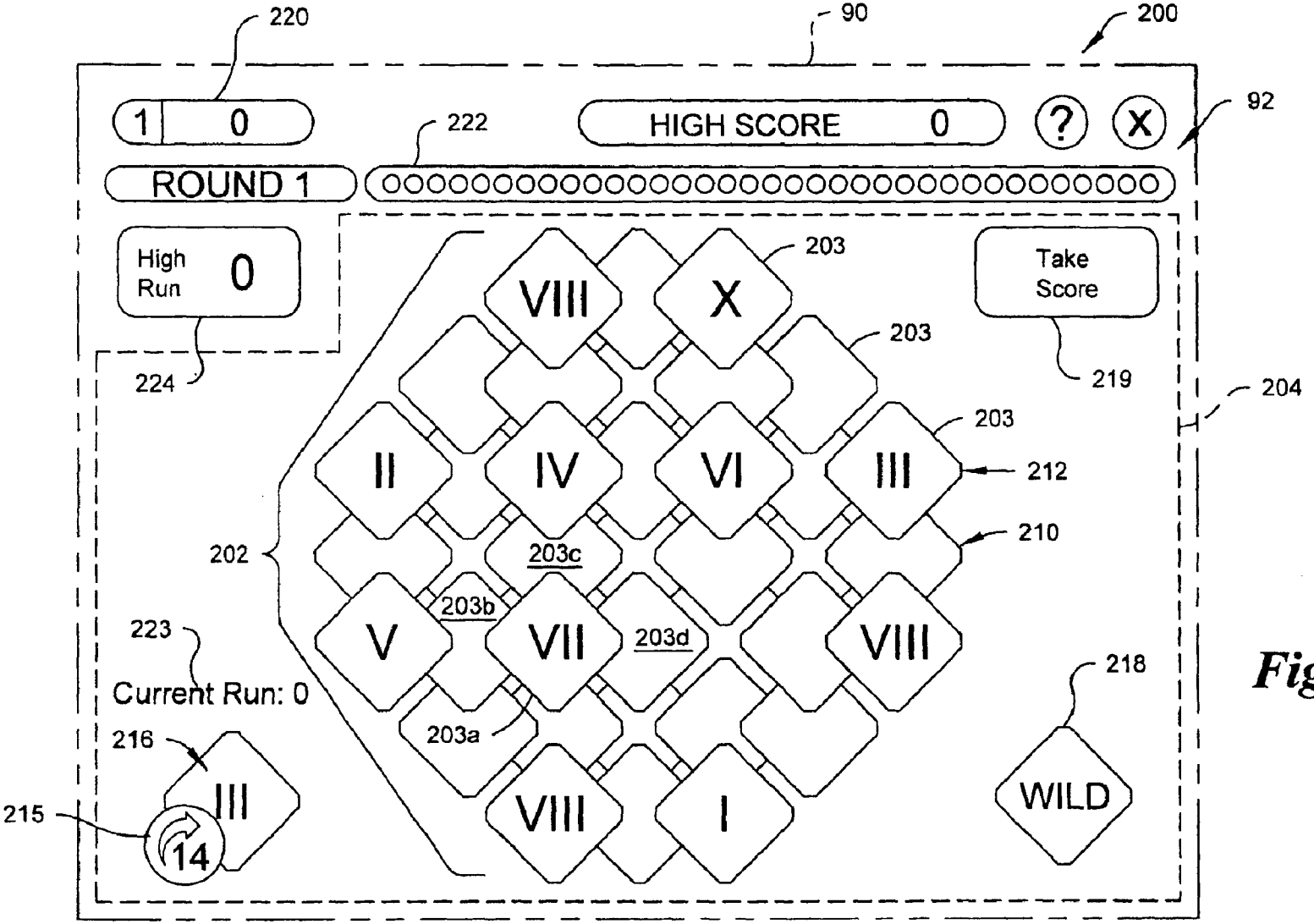
FIG. 5 is a screen shot of the electronic game having game pieces in accordance with a second preferred embodiment of the present invention.

FIGS. 5–8 depict an electronic game 200 playable in an amusement device 90 having a display 92 in accordance with a second preferred embodiment of the present invention. The electronic game 200 includes an electronic deck 202 of game pieces 203 having a plurality of individual game pieces 203. Each of the individual playing game pieces 203 has an associated value (for example, Roman numerals I–X). The electronic game 200 includes a playing area 204 within the display 92. The electronic game 200 also includes a first layer of game pieces 210 of the deck 202 disposed on the playing area 204, and a second layer of game pieces 212 of the deck 202 disposed on the playing area 204 in overlying relationship to the first layer of game pieces 210. At least one game piece 203*a* (e.g., VII) of the second layer 212 of game pieces 203 partially covers at least three game pieces 203*b*–203*d* of the first layer 210 of game pieces 203. The electronic game 200 further includes a shoe 216 of game pieces 203 configured to accept game pieces 203 of the deck 202 that have been selectively removed from the playing area 204 by a player (not shown). The shoe 216 is disposed proximate to or within the playing area 204. The electronic card game 200 further includes a deck button 215 for dealing game pieces 203 that have not been dealt. As shown in FIG. 5, fourteen (14) game pieces 203 have not been dealt. The deck button 215 is disposed proximate to or within the playing area 204. As shown in FIGS. 5–8 the deck 202 comprises the game pieces 203 in the shoe 216, the game pieces 203 that have not been dealt, and the game pieces 203 spread out on the playing area 204 in overlying relationship.

The electronic game 200 includes a set of rules which dictate scoring of the electronic game 200. The rules include selecting game pieces 203 from the playing area 204 that are not covered by other game pieces 203 and that have a face value (e.g., I–X) that is one face value higher or one face value lower than the face value of the last game pieces 203 showing in the shoe 216. The rules further include scoring points based upon a run of play. A run of play is a duration of time when the player can selectively remove game pieces 203 that are one face value higher or one face value lower than the face value of the last game pieces 203 in the shoe 216. The rules also include permitting game pieces such as 203*b*–203*d* in the first layer 210 to become playable when all the game pieces such as 203*a* which were partially covering the game pieces 203*b*–203*d* in the first layer 210 have been removed. The rules include allowing, in at least some instances, three or more game pieces 203 in the first layer 210 to become playable when one of the game pieces 203 of the second layer 212 is removed.

The game pieces 203 have face values including, for example, I, II, III, IV, V, VI, VII VII, IX, and X. However, the game pieces may include any denominations, symbols or face values using other numbering systems without departing from the present invention. The game pieces 203 may include dots like dominos, or characters representative of quantity values and the like.

The electronic game 200 may also include a wild card 218 which is disposed proximate to or within the playing area 204 and separate from the layers of game pieces 210, 212, and the shoe 216. The wild card 218 may be selectable by the player when there are no playable game pieces 203 that are one face value higher or one face value lower than the face value of the last game pieces 203 in the shoe 216. Alternatively, the wild card 218 may be selected by the player at any time, thereby permitting the player to select any playable game pieces 203 for strategic purposes.

While described above as including a first layer and a second layer of game pieces 210, 212, the electronic game 200 preferably includes a plurality of layers 210, 212 set out in overlying relationship on the playing area 204. Even further, the electronic game 200 may include a plurality of decks of game pieces 202 which form additional layers 210, 212 in overlying relationship relative to the second layer 212 of game pieces 203.

The game pieces 203 shown in FIGS. 5–8 have a unique diamond-like shape with chamfered corners thereby permitting the game pieces 203 to be positioned in overlying relationship without touching adjacent game pieces 203 in the same layer 210 or 212. However, the game pieces 203 may have other shapes such as a square shape, a rectangular shape, a circular shape, a pentagonal shape, an octagonal shape or even non-linear or non-geometric shapes.

The electronic game 200 further includes a "take score" selector 219 disposed proximate to or within the playing area 204 and separate from the layers of game pieces 210, 212 and the shoe 216. The take score selector 219 allows a user to end a round of play when the game pieces 203 remaining in the playing area 204 are no longer playable and a wild card 218 is not available. Furthermore, the player may select the deck button 215 to deal one of the game pieces 203 that were not previously dealt to the shoe 216 in an attempt to prevent a run from ending by changing the face value of the game piece 203 face up on the shoe 216.

The electronic game 200 also includes a total score indicator 220 which is disposed proximate to or within the playing area 204. A total score for a run of play is incremented or decremented based upon the number of playable game pieces 203 selected by the player in a run. The electronic game 200 also includes a time indicator 222, in this case configured as a bar graph, which displays the amount of time that a player has used during a round. A round may include multiple runs of play. A round is ended when a predetermined period of time as counted down on the time indicator 222 has elapsed, when the player selects the take score button 219 or when a player has played all of the game pieces 203 spread out on the playing area 204. Preferably, the total score which is indicated on the total score indicator 220 is also a function of the amount of time the player takes to select the next playable game pieces 203.

Figure 6:
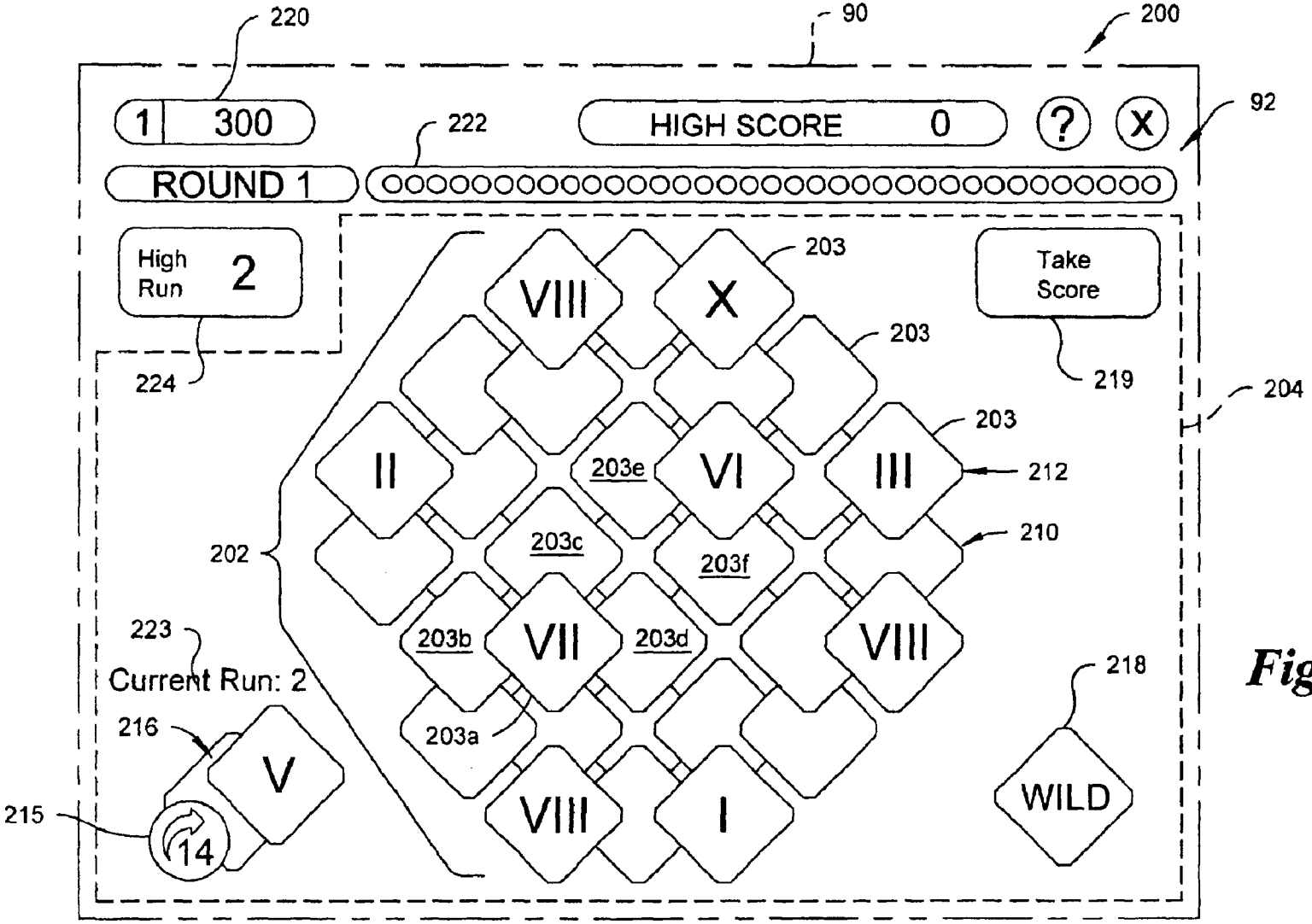
FIG. 6 is a screen shot of the electronic game of FIG. 5 after a game piece has been selectively removed by a user.
Figure 7:
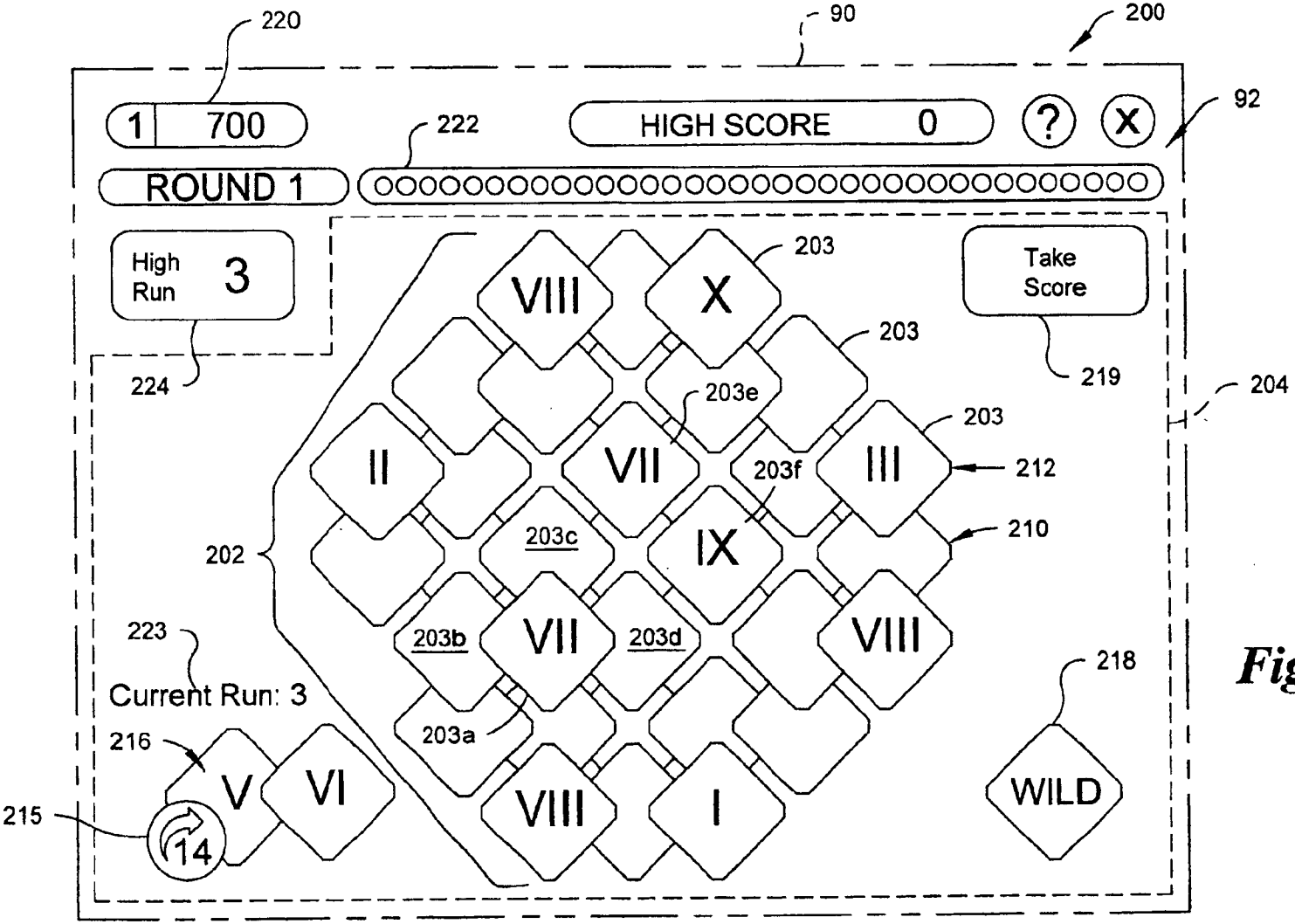
FIG. 7 is a screen shot of the electronic game of FIG. 5 after another game piece by a user.
Figure 8:
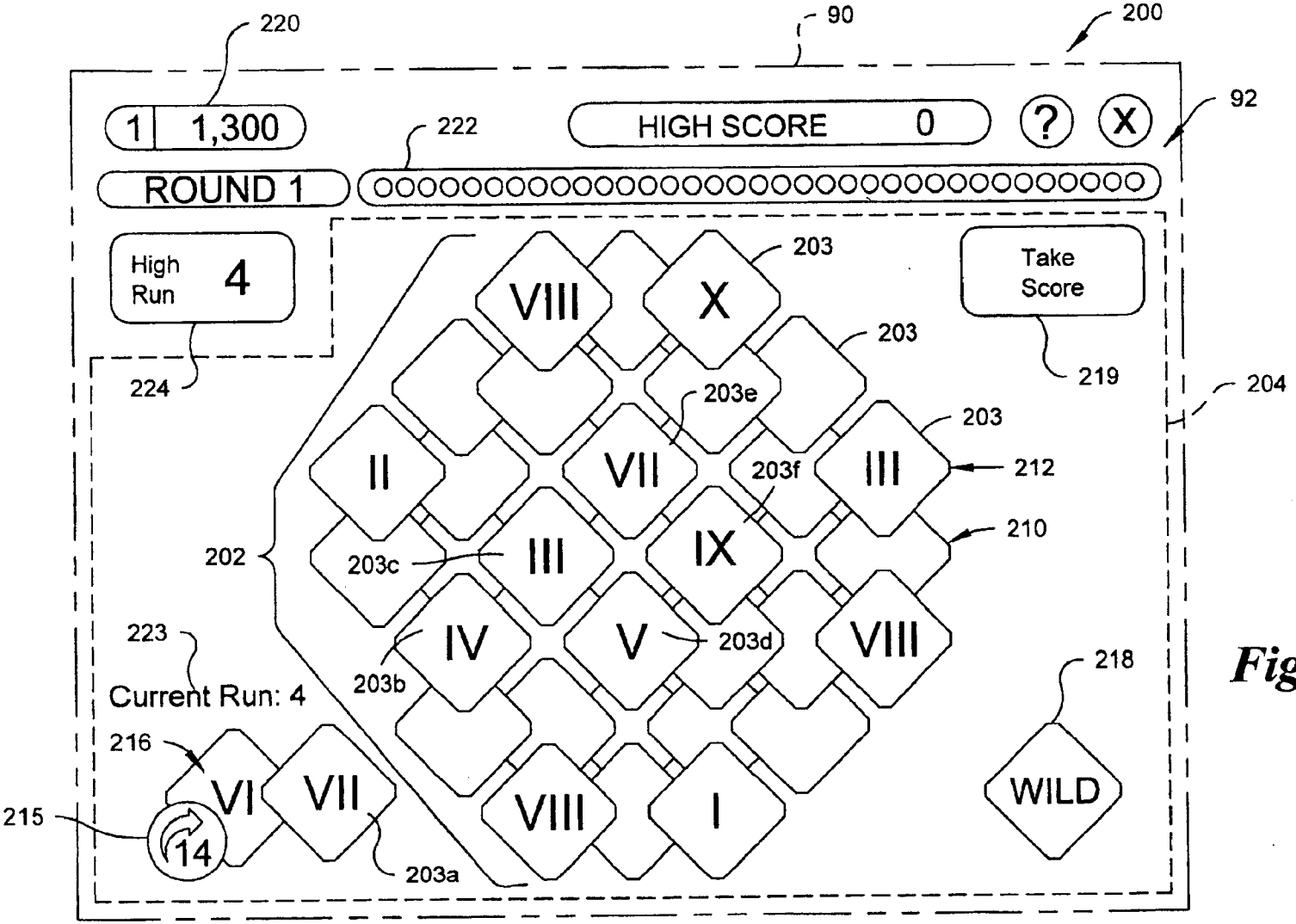
FIG. 8 is a screen shot of the electronic game of FIG. 5 after yet another game piece has been selectively removed by a user.
Figure 9:
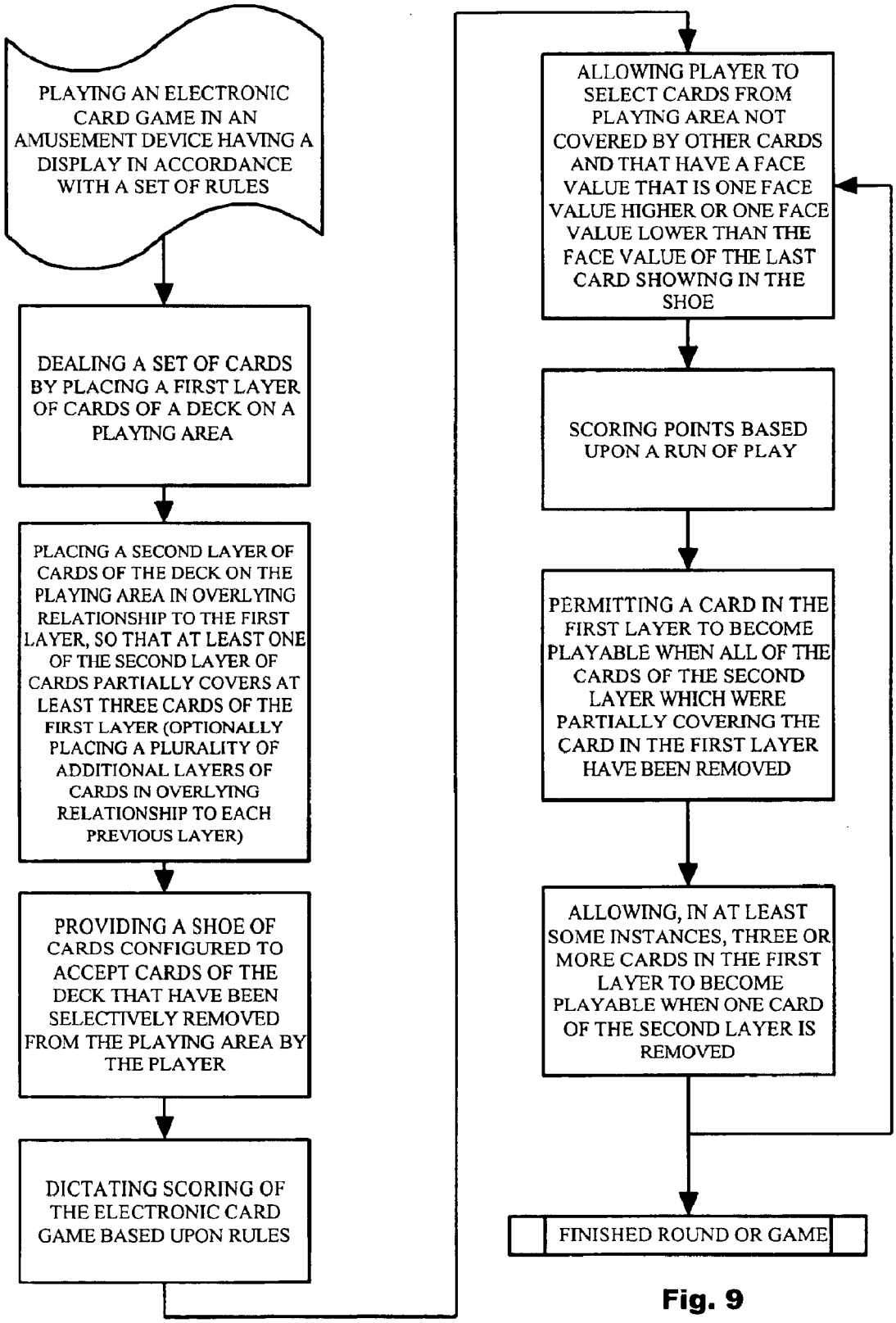
FIG. 9 is a flow diagram depicting a method of playing an electronic card game in accordance with the first preferred embodiment of the present invention.

By way of example, a run of play will be explained with respect to FIGS. 5–8. In FIG. 5, III is the top game piece 203 in the shoe 216 and the score on the indicator 220 is zero. The game pieces 203 in the second layer 212 are shown face up and include I, II, III, IV, V, VI, VII, VIII, and X. FIG. 6 shows that the player has selected the IV which was moved to the shoe 216 being one face value higher than the III. Also shown in FIG. 2, the user has selected the V which is in the process of being moved to the shoe 216 in overlying relationship to the IV which was the previous game piece 203 being one face value lower than the IV on top of the shoe 216. The score indicator shows that the player has accumulated 300 points. Although any point value can be associated with the run of play, in this particular embodiment, the score is progressively increased based upon the number of game pieces 203 selected in a single run and also as a function of the time elapsed in the time indicator 222. A current run indicator 223 shows the number of game pieces 203 selected during a particular run and moved to the shoe 216. The higher the value on the current run indicator 223, the more points a player will accumulate as displayed in the score indicator 220. A high run indicator 224 may optionally display the highest run played on a particular amusement device 90. FIG. 7 shows that a third game piece 203*a*, the VI, has been selected by the user and is being moved to the shoe 216 to cover the V which is one face value lower than the VI. The current run indicator 223 shows that the run is 3 and the score has accumulated to 700 as shown in the score indicator 220 which is obviously a non-linear increase from the number of points accumulated in the first two selections. Also note that the VI (FIG. 6) was disposed over top two game pieces 203*e*, 203*f* in the first layer 210. When the VI was removed from the second layer 212 by the user, no other game pieces 203 were then in overlying relationship with those particular game pieces 203*e*, 203*f*, thereby allowing those game pieces 203*e*, 203*f* to become playable (i.e., the VI and IX, respectively). FIG. 8 shows that the VII has been removed from the second layer 212 of game pieces 203 and is being moved to the shoe 216 which is permissible because the VII is one face value higher than the VI. The current run indicator 223 shows that this is the fourth game piece 203 in the run and accordingly, the score indicated in the score indicator 220 has increased in non-linear relationship to the previous three runs and is now showing 1300. When the VII was removed from the second layer 212, game pieces 203*b*, 203*c* and 203*d* in the first layer 210 were no longer covered, and therefore, game pieces 203*b*, 203*c* and 203*d*, the IV, III and V, respectively, became playable. When the VII (game piece 203*a*) was removed, all three game pieces 203*b*–203*d* became playable in accordance with the rules.

A round of play may comprise one or multiple runs of play depending on the rules. As noted above, a round may be a predetermined period of time or until the player takes an action such as selecting the take score button 19 or 219. Alternatively, the game need not be played with rounds but may simply end after the predetermined period of time or after the player has exhausted all of the playable cards 103 or game pieces 203. It is further contemplated that the amusement device 90 may be money, coin or credit operated and that a certain number of rounds will be granted for a certain number of credits. Bonus rounds may or may not be awarded based upon achieving a high score or a certain score within a set period of time.

From the foregoing, it can been seen that the present inventions comprises an electronic card game and method therefore including a set of rules dictating scoring of the game including allowing, in some instances, three or more cards in a layer to become playable when one card of preceding layer is removed. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An electronic card game playable in an amusement device having a display, the card game comprising:

(a) an electronic deck of cards having a plurality of individual playing cards, each of the individual playing cards having an associated face value;

(b) a playing area within the display;

(c) a first layer of cards of the deck being disposed on the playing area;

(d) a second layer of cards of the deck being disposed on the playing area in overlying relationship to the first layer of cards, at least one card of the second layer of cards partially covering at least three cards of the first layer of cards;

(e) a shoe of cards configured to accept cards of the deck that have been selectively removed from the playing area by a player, the shoe being disposed proximate to or within the playing area; and (f) a set of rules dictating scoring of the electronic card game, the rules including:

(i) selecting cards from the playing area that are not covered by other cards and that have a face value that is one face value higher or one face value lower than the face value of the last card showing in the shoe;

(ii) scoring points based upon a run of play, a run of play being a duration of time when the player can selectively remove cards that are one face value higher or one face value lower than the face value of the last card in the shoe;

(iii) permitting a card in the first layer to become playable when all of the cards of the second layer which were partially covering the card in the first layer have been removed; and (iv) allowing, in at least some instances, three or more cards in the first layer to become playable when one card of the second layer is removed.

2. The electronic card game system of claim 1, wherein the cards have conventional face values including Ace, two, three, four, five, six, seven, eight, nine, ten, Jack, Queen and King.

3. The electronic card game of claim 2, wherein the cards further include denominations including Hearts, Diamonds, Clubs and Spades.

4. The electronic card game of claim 1, further comprising:

(g) a total score indicator being disposed proximate to or within the playing area, the total score being incremented or decremented based upon the number of cards selected by the player in a run.

5. The electronic card game of claim 4, wherein the total score is also a function of the amount of time the player takes to select the next playable card.

6. The electronic card game of claim 1, further comprising:

(g) a wildcard being disposed proximate to or within the playing area and separate from the layers of cards and the shoe, the wildcard being selectable by the player when there are no playable cards that are one face value higher or one face value lower than the face value of the last card in the shoe.

7. The electronic card game of claim 1, further comprising:

(g) a wildcard being disposed proximate to or within the playing area and separate from the layers of cards and the shoe, the wildcard being selectable by the player at anytime thereby permitting the player to select any playable card.

8. The electronic card game of claim 1, further comprising:

(g) a plurality of decks of cards forming additional layers in overlying relationship relative to the second layer of cards.

9. The electronic card game of claim 1, wherein the cards have a polygonal shape with more than four sides to permit overlying relationship with more than four cards.

10. The electronic card game of claim 1, wherein the cards have a shape selected from the group consisting of a diamond shape, a square shape, a rectangular shape, a circular shape, a pentagonal shape, a octagonal shape, and a non-linear shape.

11. A method of playing an electronic card game in an amusement device having a display in accordance with a set of rules, the electronic card game including a playing area within the display and an electronic deck of cards having a plurality of individual playing cards, each of the individual playing cards having an associated face value, the method comprising:

(a) placing a first layer of cards of the deck on the playing area;

(b) placing a second layer of cards of the deck on the playing area in overlying relationship to the first layer of cards so that at least one card of the second layer of cards partially covers at least three cards of the first layer of cards;

(c) providing a shoe of cards configured to accept cards of the deck that have been selectively removed from the playing area by a player, the shoe being disposed proximate to or within the playing area; and (d) dictating scoring of the electronic card game based upon the rules, the rules including:

(i) selecting cards from the playing area that are not covered by other cards and that have a face value that is one face value higher or one face value lower than the face value of the last card showing in the shoe;

(ii) scoring points based upon a run of play, a run of play being a duration of time when the player can selectively remove cards that are one face value higher or one face value lower than the face value of the last card in the shoe;

(iii) permitting a card in the first layer to become playable when all of the cards of the second layer which were partially covering the card in the first layer have been removed; and (iv) allowing, in at least some instances, three or more cards in the first layer to become playable when one card of the second layer is removed.

12. The method of playing an electronic card game according to claim 11, wherein the cards have conventional face values including ace, two, three, four, five, six, seven, eight, nine, ten, jack, queen and king.

13. The method of playing an electronic card game according to claim 12, wherein the cards further include denominations including hearts, diamonds, clubs and spades.

14. The method of playing an electronic card game according to claim 11, further comprising:

(g) a total score indicator being disposed proximate to or within the playing area, the total score being incremented or decremented based upon the number of cards selected by the player in a run.

15. The method of playing an electronic card game according to claim 14, wherein the total score is also a function of the amount of time the player takes to select the next playable card.

16. The method of playing an electronic card game according to claim 11, wherein the game further comprises a wildcard being disposed proximate to or within the playing area and separate from the layers of cards and the shoe, the wildcard being selectable by the player when there are no playable cards that are one face value higher or one face value lower than the face value of the last card in the shoe.

17. The method of playing an electronic card game according to claim 11, wherein the game further comprises a wildcard being disposed proximate to or within the playing area and separate from the layers of cards and the shoe, the wildcard being selectable by the player at anytime thereby permitting the player to play any playable card.

18. The method of playing an electronic card game according to claim 11, wherein the game further comprises a plurality of decks of cards forming additional layers in overlying relationship relative to the second layer of cards.

19. The method of playing an electronic card game according to claim 11, wherein the cards have a polygonal shape with more than four sides to permit overlying relationship with more than four cards.

20. The method of playing an electronic card game according to claim 11, wherein the cards have a shape selected from the group consisting of a diamond shape, a square shape, a rectangular shape, a circular shape, a pentagonal shape, a octagonal shape, and a non-linear shape.

21. The method of playing an electronic card game according to claim 11, further comprising:

(e) placing a third layer of cards of the deck on the playing area in overlying relationship to the second layer of cards so that at least one card of the third layer of cards partially covers at least three cards of the second layer of cards.

22. An electronic game playable in an amusement device having a display, the game comprising:

(a) an electronic deck of gamepieces having a plurality of individual gamepieces, each of the individual gamepieces having an associated face value and at least three of the gamepieces having different face values;

(b) a playing area within the display;

(c) a first layer of gamepieces of the deck being disposed on the playing area;

(d) a second layer of gamepieces of the deck being disposed on the playing area in overlying relationship to the first layer of gamepieces, at least one gamepieces of the second layer of gamepieces partially covering at least three gamepieces of the first layer of gamepieces;

(e) a shoe of gamepieces configured to accept gamepieces of the deck that have been selectively removed from the playing area by a player, the shoe being disposed proximate to or within the playing area; and (f) a set of rules dictating scoring of the electronic game, the rules including:

(i) selecting gamepieces from the playing area that are not covered by other gamepieces and that have a face value that is one face value higher or one face value lower than the face value of the last gamepieces showing in the shoe;

(ii) scoring points based upon a run of play, a run of play being a duration of time when the player can selectively remove gamepieces that are one face value higher or one face value lower than the face value of the last gamepieces in the shoe;

(iii) permitting a gamepieces in the first layer to become playable when all of the gamepieces of the second layer which were partially covering the gamepieces in the first layer have been removed; and (iv) allowing, in at least some instances, three or more gamnepieces in the first layer to become playable when one gamepieces of the second layer is removed.

23. The electronic game of claim 22, further comprising:

(g) a total score indicator being disposed proximate to or within the playing area, the total score being incremented or decremented based upon the number of gamepieces selected by the player in a run.

24. The electronic game of claim 23, wherein the total score is also a function of the amount of time the player takes to select the next playable gamepiece.

25. The electronic game of claim 22, further comprising:

(g) a wild gamepieces being disposed proximate to or within the playing area and separate from the layers of gamepieces and the shoe, the wild gamepieces being selectable by the player when there are no playable gamepieces that are one face value higher or one face value lower than the face value of the last gamepieces in the shoe.

26. The electronic game of claim 22, further comprising:

(g) a wild gamepieces being disposed proximate to or within the playing area and separate from the layers of gamepieces and the shoe, the wild gamepieces being selectable by the player at anytime thereby permitting the player to select any playable gamepiece.

27. The electronic game of claim 22, further comprising:

(g) a plurality of decks of gamepieces forming additional layers in overlying relationship relative to the second layer of gamepieces.

28. The electronic game of claim 22, wherein the gamepieces have a polygonal shape with more than four sides to permit overlying relationship with more than four gamepieces.

29. The electronic game of claim 22, wherein the gamepieces have a shape selected from the group consisting of a diamond shape, a square shape, a rectangular shape, a circular shape, a pentagonal shape, a octagonal shape, and a non-linear shape.

* * * * *